US005645418A

United States Patent [19]

Thomas

[11] Patent Number: 5,645,418

[45] Date of Patent: Jul. 8, 1997

[54] PUSHER FURNACE DROP-OUT CONVEYOR

[75] Inventor: John E. Thomas, Pittsburgh, Pa.

[73] Assignee: Tippins Incorporated, Pittsburgh, Pa.

[21] Appl. No.: 603,397

[22] Filed: Feb. 20, 1996

[51] Int. Cl.[6] ..... F27D 3/04; F27D 3/00

[52] U.S. Cl. ..... 432/239; 432/122

[58] Field of Search ..... 432/121–126, 432/239; 110/101 R; 198/409, 468.6; 414/154, 156, 157, 172, 198

[56] References Cited

U.S. PATENT DOCUMENTS

| | | | |
|---|---|---|---|
| 726,814 | 4/1903 | Carroll . | |
| 1,137,711 | 4/1915 | Gottschalk . | |
| 1,465,572 | 8/1923 | Bailey . | |
| 2,504,707 | 4/1950 | Lloyd | 263/40 |
| 2,514,666 | 7/1950 | Nelson | 263/40 |
| 3,700,122 | 10/1972 | Sevenich et al. | 198/221 |
| 4,421,481 | 12/1983 | Holz et al. | 432/239 |
| 4,449,922 | 5/1984 | Finke | 432/64 |
| 4,938,690 | 7/1990 | Thomlinson et al. | 432/239 |
| 5,136,610 | 8/1992 | Heuss | 373/109 |

FOREIGN PATENT DOCUMENTS

| | | | |
|---|---|---|---|
| 626625 | 12/1926 | France | 432/122 |
| 1199302 | 5/1960 | Germany | 414/198 |

*Primary Examiner*—Henry A. Bennett
*Assistant Examiner*—Gregory A. Wilson
*Attorney, Agent, or Firm*—Webb Ziesenheim Bruening Logsdon Orkin & Hanson, P.C.

[57] ABSTRACT

A drop-out conveyor for a pusher-type slab reheat furnace having a sloped dropout is disclosed. The drop-out conveyor comprises a plurality of reciprocating slab carts movable between a first loading position within the furnace and a second discharge position outside of the furnace. A track is provided for supporting each of the carts along the sloped dropout of the furnace between the loading position and the discharge position. A mechanism is provided for reciprocating each cart between the first position and the second position. The present invention additionally includes a device for removing the slabs from the slab cart to a roller table at the discharge position.

19 Claims, 8 Drawing Sheets

STEP 1:
SLAB IS PUSHED ONTO CAR, WHICH IS POSITIONED NEAR FURNACE SKID LINE.

STEP 2:
SLAB IS LOWERED TO
BACK END OF CAR.

STEP 3:
CAR TRANSPORTS SLAB DOWN RAMP & OUT OF FURNACE.

4/8

STEP 4 :
CAR TRANSPORTS SLAB DOWN RAMP & OUT OF FURNACE.

5/8

STEP 5:
CAR POSITIONS SLAB
AT CENTER OF TABLE.

STEP 6:
THREE HYDRAULIC CYLINDERS LOWER SECTION OF STRUCTURE, DEPOSITING SLAB ONTO TABLE ROLLERS.

PUSHER FURNACE DROP-OUT CONVEYOR

BACKGROUND OF THE INVENTION

1. Field of the Invention

The present invention relates to reheat furnaces and, more particularly, to a drop-out conveyor for a pusher-type slab reheat furnace for discharging a product such as a slab from the furnace hearth line to an adjacent processing line external of the furnace such as a hot rolling mill.

2. Description of the Prior Art

In general, pusher-type slab reheat furnaces include a drop-out slope at a discharge end of the furnace in which the slope is used to gravity feed slabs from a furnace hearth line to an adjacent processing line external of the furnace. A conventional pusher-type reheat furnace arrangement is illustrated in U.S. Pat. No. 4,449,922 to Finke. The sliding of the slabs down the furnace discharge slope onto an external conveyor can damage the conveyor and, more significantly, can damage the slabs, possibly increasing the yield loss or incorporating defects into the work product.

Various attempts have been made to provide for mechanical unloading structures for heating furnaces. U.S. Pat. No. 4,421,481 to Holz et al. utilizes an unloading structure located adjacent a discharge end of a slab heating furnace for unloading the heated slab from a carriage traveling through the furnace. The unloading structure is a reciprocating, vertically movable forklift-type device. The Holz et al. design additionally incorporates a complex arrangement for returning the carriage to the beginning of the furnace to transport another slab therethrough.

U.S. Pat. No. 4,938,690 to Thomlinson et al. discloses an ingot heating furnace which utilizes an ingot-handling pivoted table at the exit of the furnace. The ingots are held upright on shoes as they are transported through the furnace.

U.S. Pat. No. 2,504,707 to Lloyd discloses a furnace for heating ingots in which the ingots travel through the heat furnace on carriages and then are subsequently removed from the carriages by a crane reciprocating between the exit of the furnace and the table for subsequent processing on a rolling mill.

U.S. Pat. No. 726,814 to Carroll discloses a billet heating furnace which utilizes a chain drive extending therethrough for driving a workpiece through the furnace. The chain drive continues from the exit of the furnace through a water cooling pit to the beginning of the furnace to complete the chain loop.

These prior art designs suffer from several distinct disadvantages. First, the systems do not represent cost-effective solutions for pusher-type slab reheat furnaces. Additionally, none of these designs can be easily retrofitted for incorporation into pusher-type slab reheat furnaces. The object of the present invention is to provide an economic solution for pusher-type slab reheat furnaces which can be incorporated into new facilities or easily retrofitted into existing pusher-type slab reheat furnaces.

SUMMARY OF THE INVENTION

The objects of the present invention are achieved by providing a drop-out conveyor for a pusher-type slab reheat furnace having a sloped dropout. The conveyor includes at least one reciprocating slab cart. The slab cart is movable between a first loading position within the furnace for receiving a slab thereon and a second discharge position outside of the furnace for discharging the slab. A track is provided for supporting each slab cart with each track extending at least between the first loading position and the second discharge position. A mechanism is provided for reciprocating each cart between a first position and the second position.

The present invention may provide a reciprocating slab table positioned on each cart with the slab table movable between an extended slab receiving position when the cart is in the first loading position and a retracted slab transporting position. The slab table includes a substantially planar base with a slab stop extending upwardly therefrom substantially perpendicular to the base at a rearward portion thereof. A piston may be provided on the slab cart coupled to the slab table for reciprocating the slab table.

The present invention may be provided with a drive chain for each slab cart with a linkage coupling each slab cart to the associated drive chain. The mechanism for reciprocating the drive cart may include at least one reciprocating motor reversibly driving each drive chain.

The present invention may additionally include a piston or other mechanism coupled to the track for raising and lowering at least a portion of the track. The lowering of a portion of the track will result in the lowering of the associated slab cart in the second discharge position to a location below the upper surface of a roller table. In this manner, the slab carried by the slab cart can be easily transferred to an appropriate roller table. The present invention may include a plurality of tracks positioned between adjacent rollers of the roller table with a slab cart positioned on each track.

These and other advantages of the present invention will be clarified in the description of the preferred embodiment wherein like reference numerals represent like elements throughout.

BRIEF DESCRIPTION OF THE PREFERRED EMBODIMENT

Figure 7:
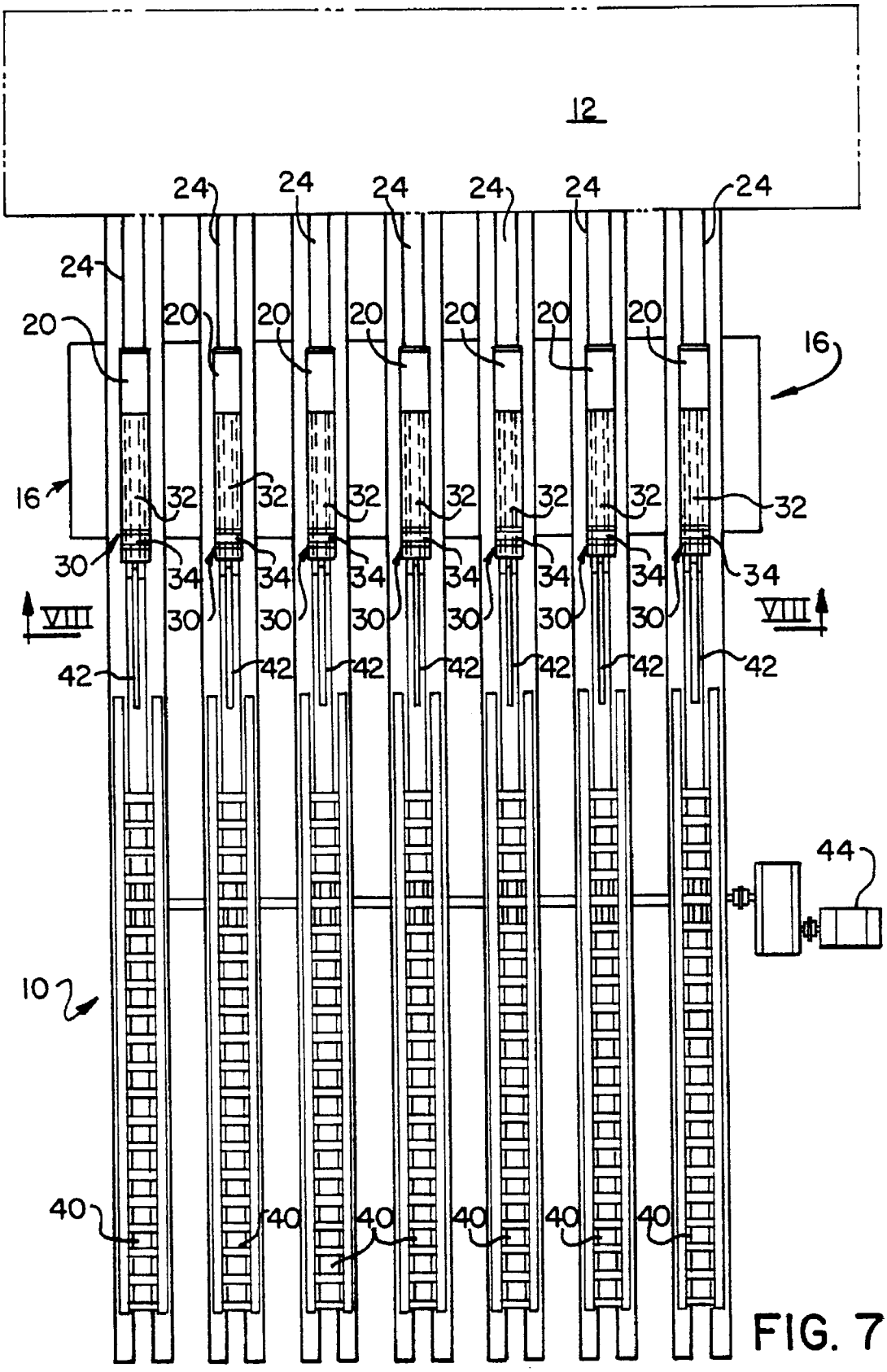
FIG. 7 is a top plan view of the drop-out conveyor illustrated in FIGS. 1–6.
Figure 8:
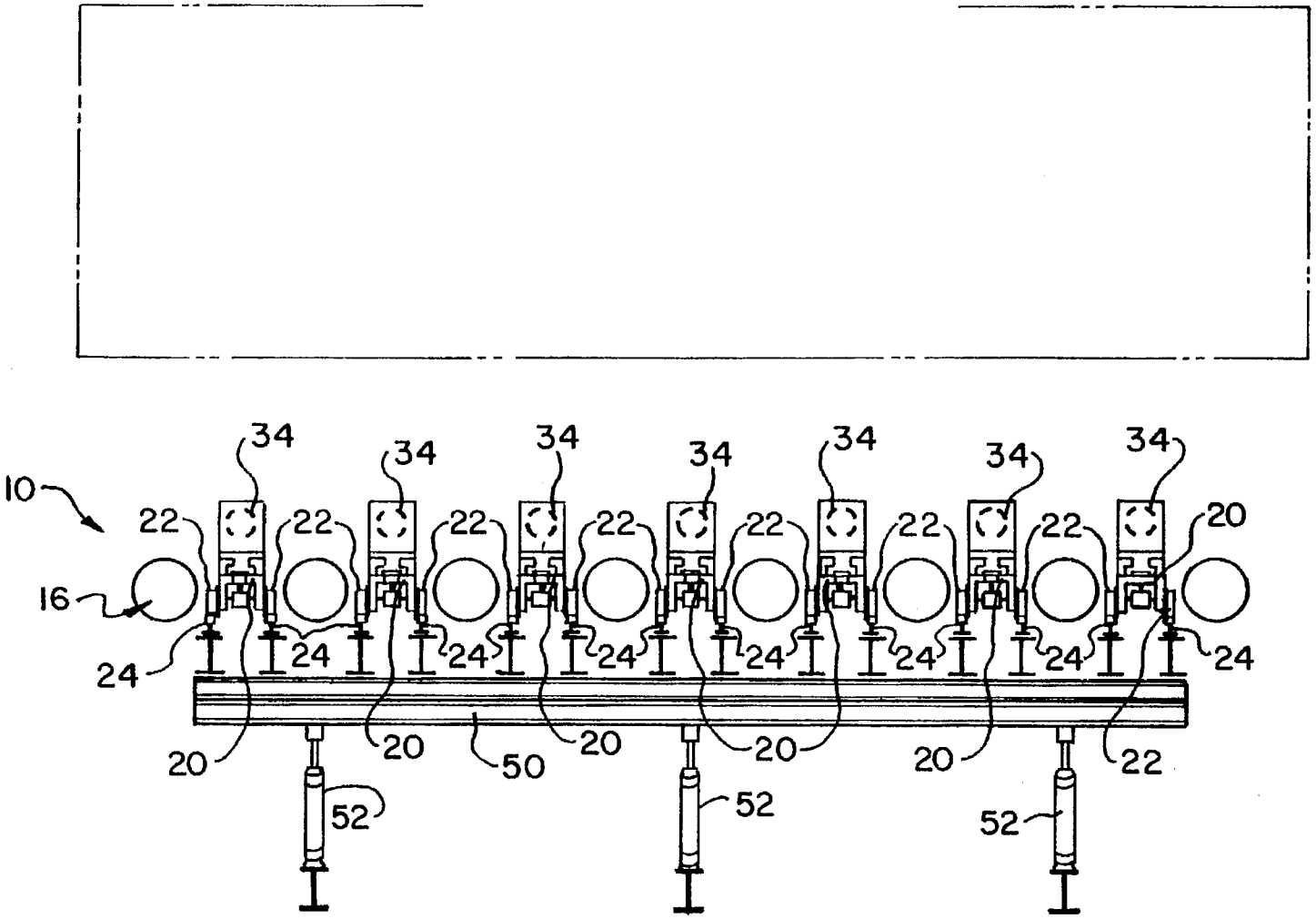
FIG. 8 is a sectional view of the drop-out conveyor illustrated in FIG. 7 taken along line X—X.

A drop-out conveyor 10 for a conventional pusher-type slab reheat furnace 12 having a downwardly sloped dropout is illustrated in sequential operation in FIGS. 16. The drop-out conveyor 10 moves slabs 14 from the downwardly sloped discharge end of the furnace 12 to a roller table 16 which is best shown in FIGS. 7 and 8. The roller table 16 is adapted to receive the slabs 14 from the drop-out conveyor 10 and transports the slabs 14 for further processing such as hot rolling.

Figure 5:
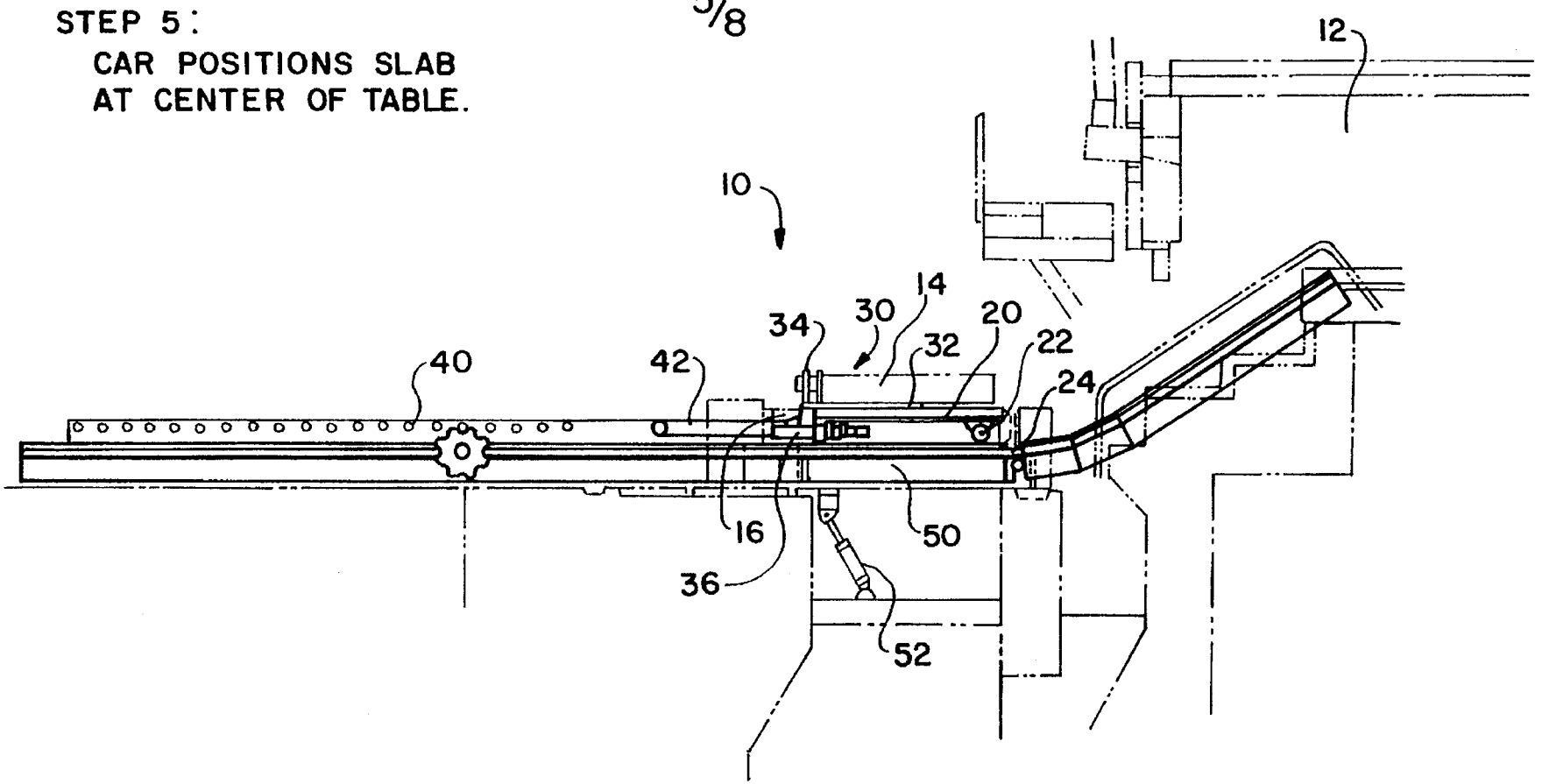
Figure 6:
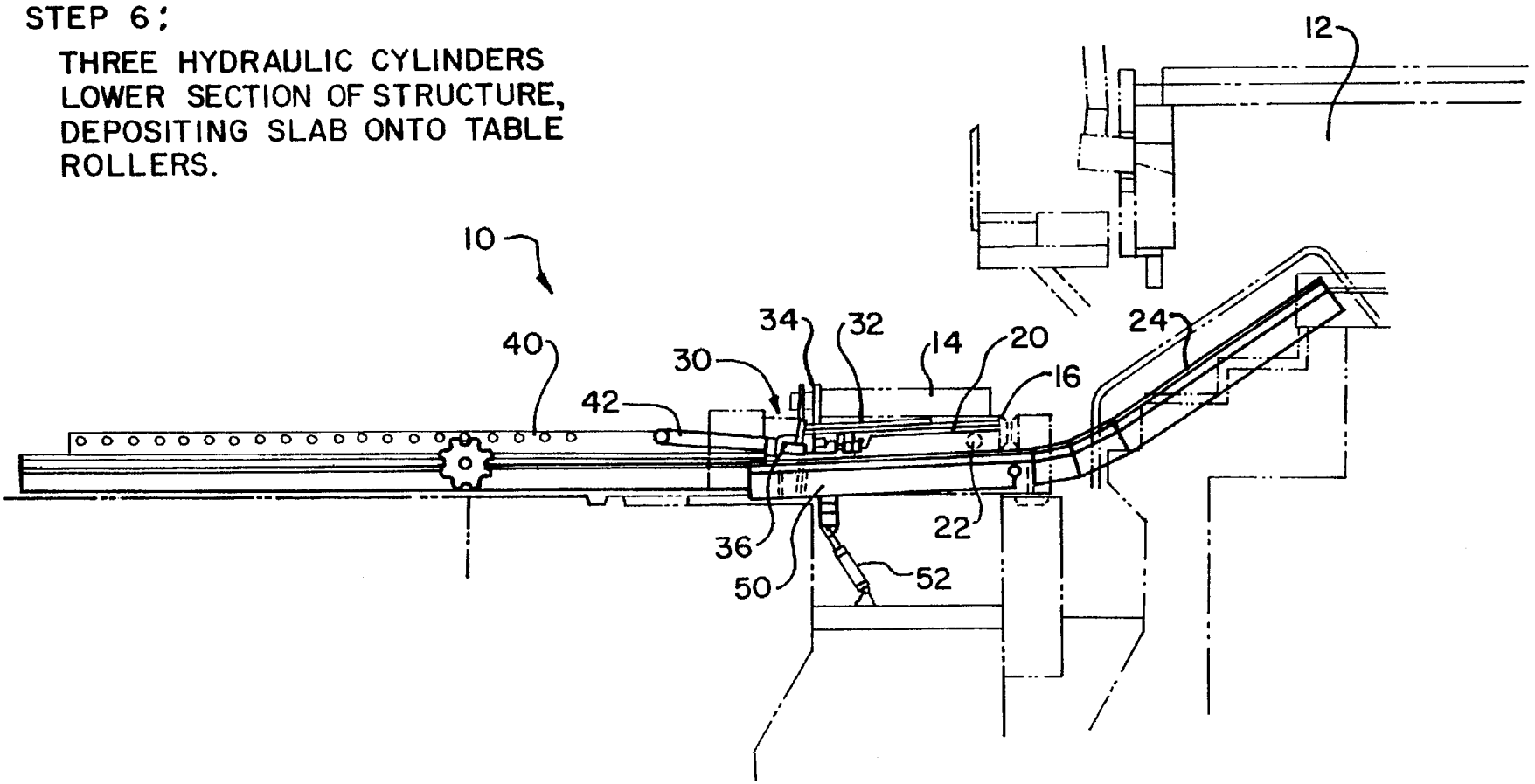

The drop-out conveyor 10 includes a plurality of spaced reciprocating slab carts 20 movable between a first slab loading position at an upper end of the sloped dropout of the furnace 12 in operative line with the furnace hearth and a second slab discharge position shown in FIGS. 5 and 6 located outside of the furnace 12 for discharging the slabs 14 to the roller table 16. Each slab cart 20 includes cart wheels 22 which are adapted to ride on a track 24 which extends along the dropout of the furnace 12 between the first loading position of the slab cart 20 to at least the second discharge position of the slab cart 20. As best illustrated in FIGS. 7 and 8, track 24 and associated slab cart 20 are positioned between adjacent rollers of the roller table 16 substantially along the entire width of the furnace 12. This construction allows the drop-out conveyor 10 to accommodate slabs 14 of varying widths up to the maximum width capacity of the furnace 12.

Figure 1:
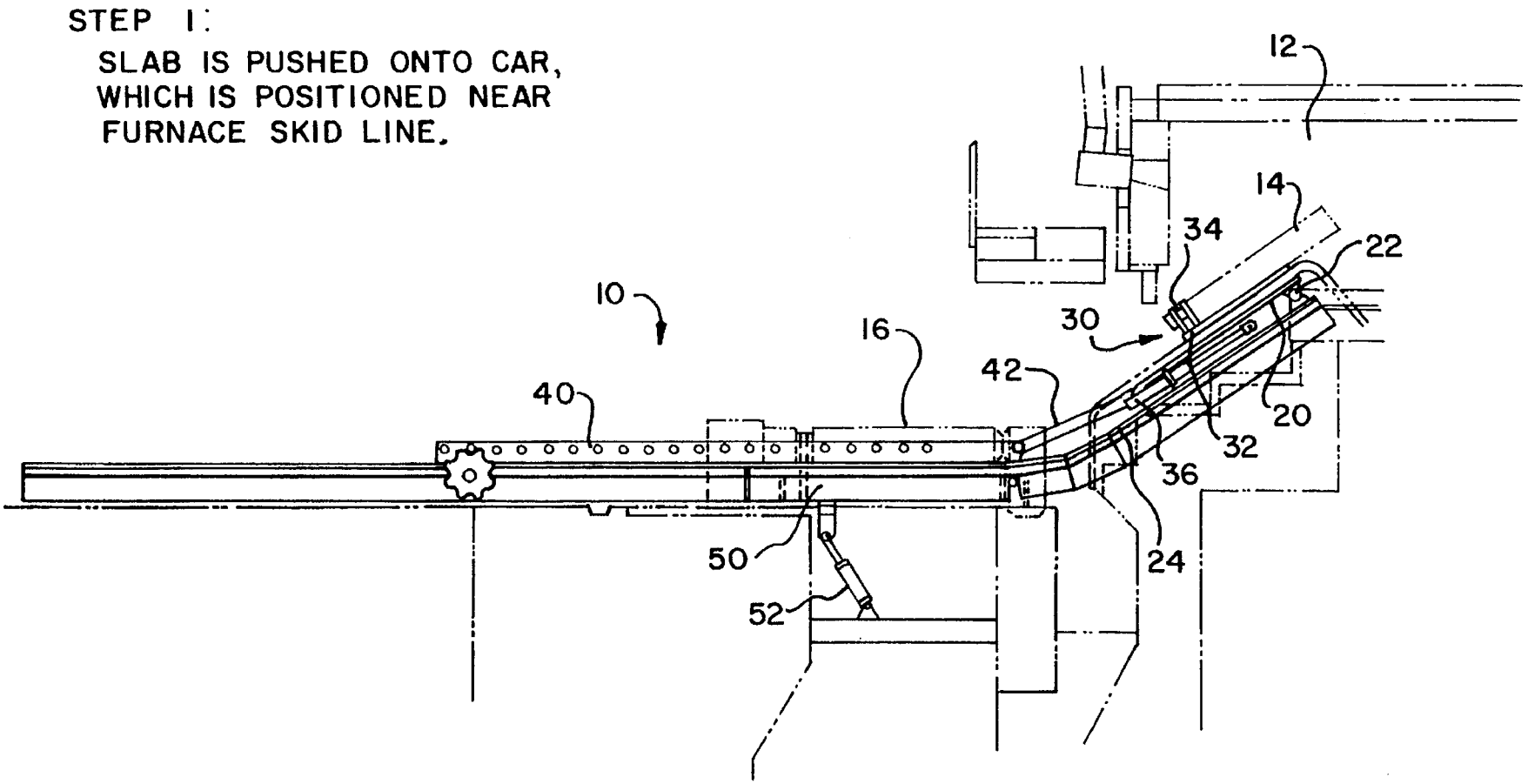
FIGS. 1–6 are sequential side views of the drop-out conveyor for a pusher-type slab reheat furnace according to the present invention illustrating the transportation of a slab from the furnace to a roller table.
Figure 2:
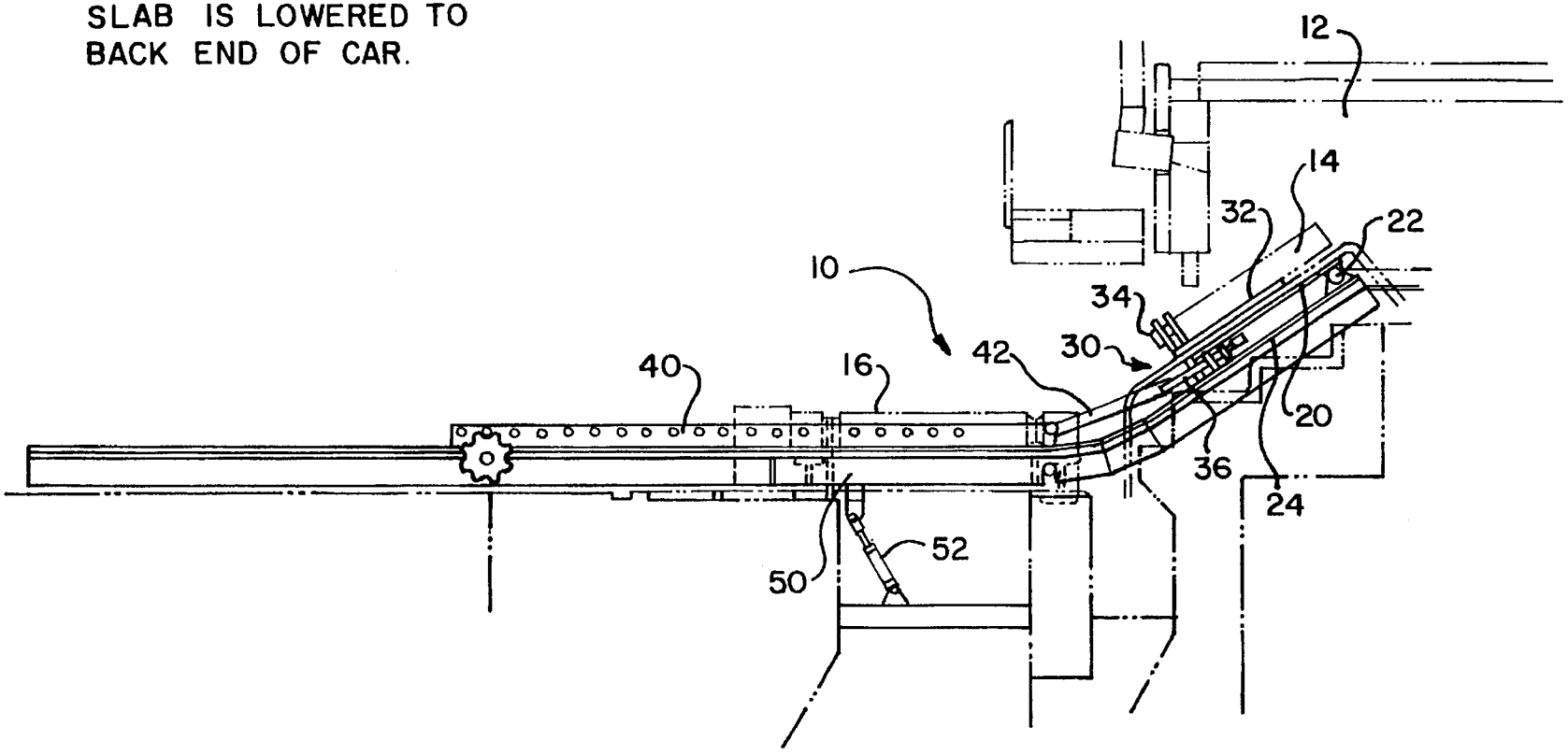

Each slab cart 20 includes a slab table 30 slidably received thereon. The slab table 30 includes a substantially planar base 32 and a slab stop 34 extending upwardly from the base 32 substantially perpendicular thereto at a rearward portion of the base 32. A reciprocating piston 36 is carried on the slab cart 20 and attached to the slab table 30. The slab table 30 is reciprocated on the slab cart 20 by the piston 36 between an extended slab receiving position shown in FIG. 1 and a retracted slab transporting position shown in FIGS. 2–6.

A drive chain 40 is provided for each slab cart 20. Each drive chain 40 is pivotally coupled to the associated slab cart 20 by pivotable linkage member 42. The drive chains 40 are preferably also supported on tracks 24 and are driven by reciprocating drive motor 44. Movement of the drive chains 40 by the drive motor 44 will result in a corresponding movement of slab cart 20 providing for the reciprocation between the slab loading position shown in FIG. 1 and the slab discharge position shown in FIGS. 5 and 6. Separate drive motors 44 may be provided for the individual drive chains 40 allowing selected slab carts 20 to be utilized for slabs 14 of different widths. However, the use of a single drive motor 44 provides for easy alignment of the multiple slab carts 20.

A portion of each track 24 which is aligned with the roller table 16 is movable up and down as illustrated in FIGS. 5 and 6. This portion of each track 24 is supported on a platform 50 movable by three spaced cylinders 52 as shown in FIG. 8.

Figure 3:
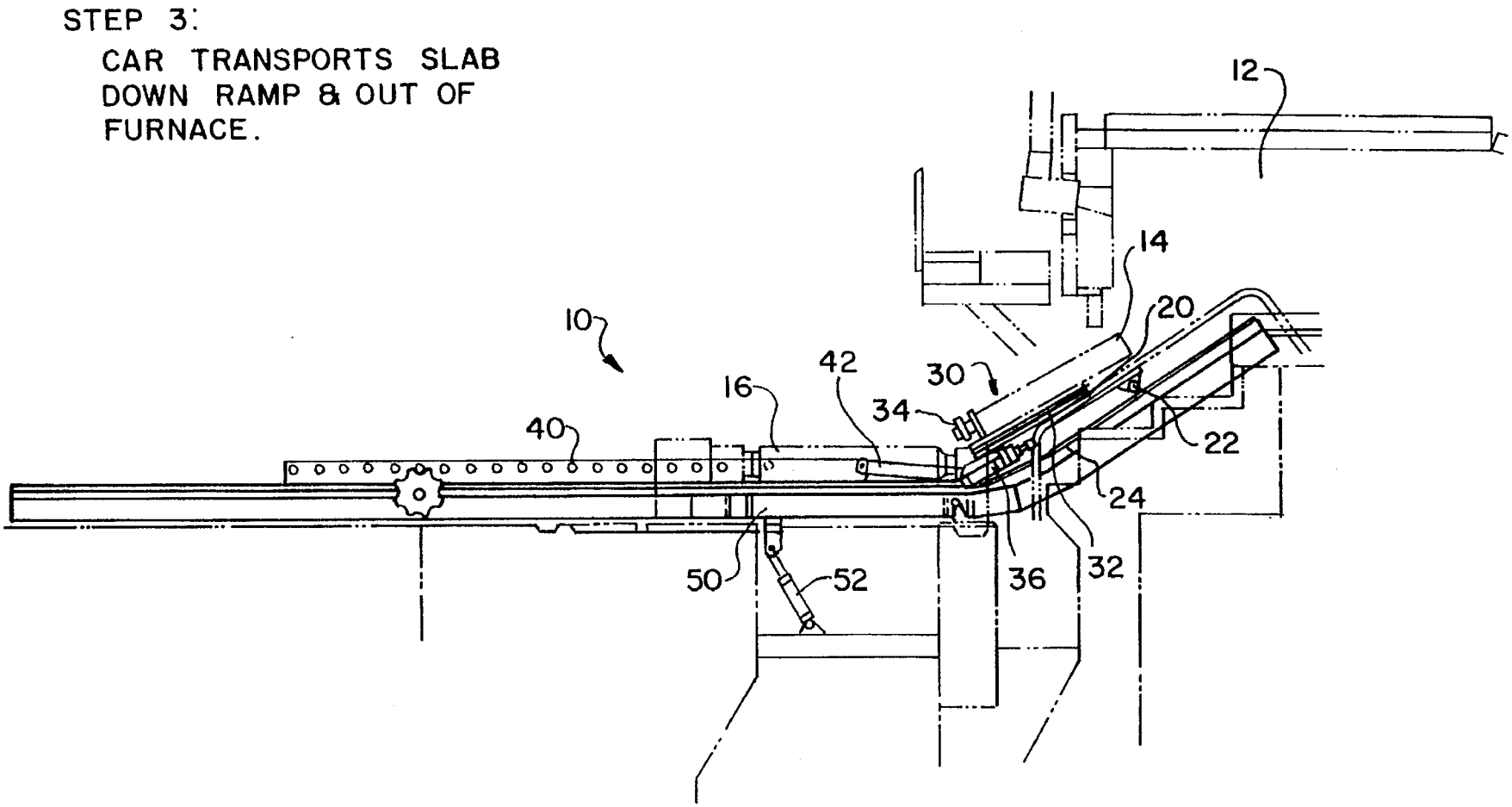
Figure 4:
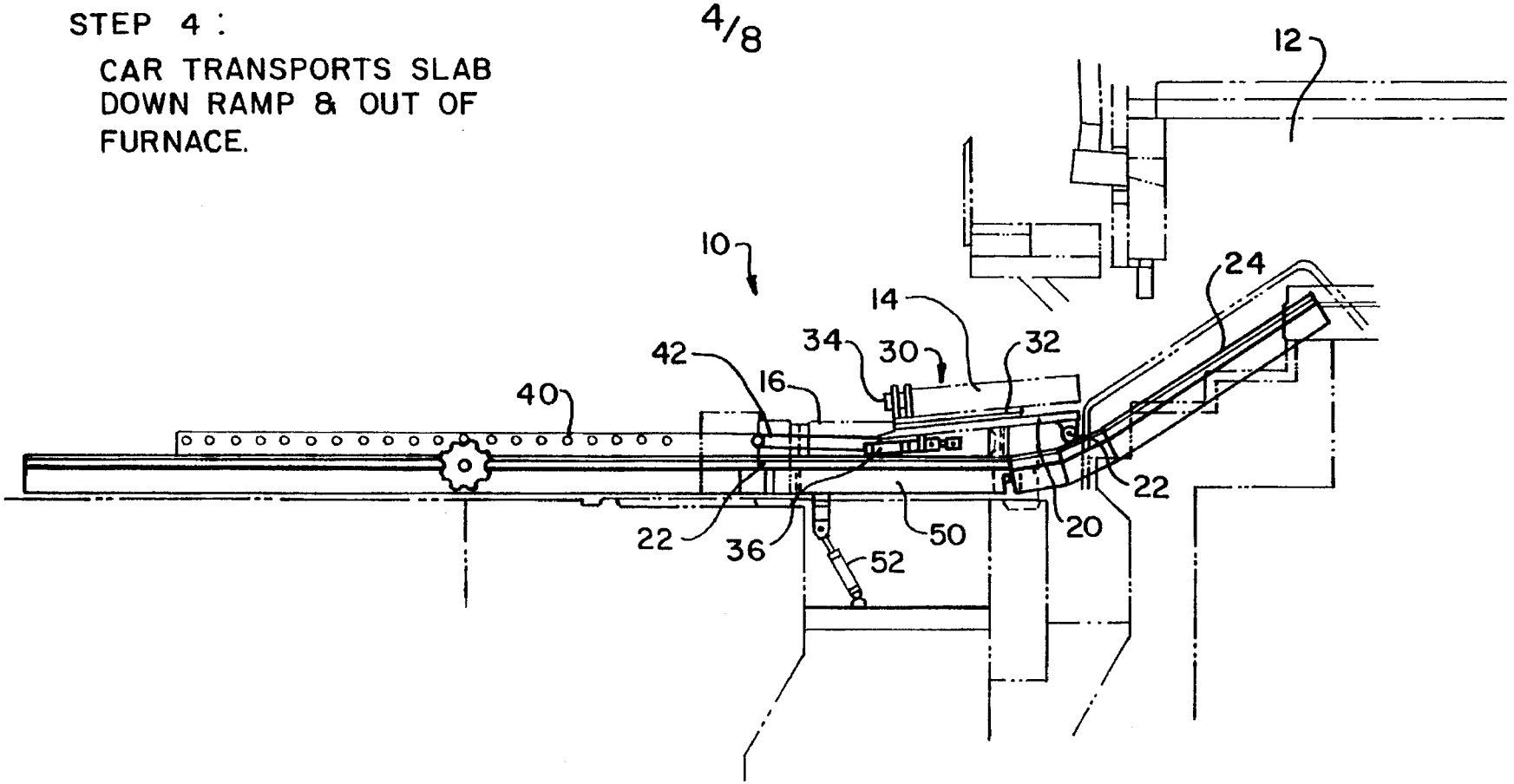

The drop-out conveyor 10 operates as follows. Drive motor 44 is operated to move the drive chains 40 to drive the slab carts 20 up the sloped dropout of the furnace 12 to the slab loading position within the furnace 12 illustrated in FIG. 1. The piston 36 on each slab cart 20 is extended to move the slab table 30 to the slab receiving position shown in FIG. 1. With the slab carts 20 and the slab tables 30 in the appropriate position, the slab 14 is pushed onto slab tables 30 by entry of another slab into the furnace 12. Gravity will provide that the slab 14 is resting on the base 32 against the slab stop 34 of each slab table 30. The slab 14 is then lowered to the back of the slab carts 20 by retracting each piston 36 causing movement of each slab table 30 to the slab transporting position illustrated in FIG. 2. Drive motor 44 will be rotated in the opposite direction to drive the drive chains 40 and move the slab carts 20 down the sloped dropout of the furnace 12 as shown in FIG. 3 and out of the furnace 12 as shown in FIG. 4. The drive motor 44 will continue to drive the drive chains 40 to move the slab carts 20 and position the slab 14 in the center of the roller table 16 at the slab discharge position illustrated in FIG. 5. In this position, the hydraulic cylinders 52 are operated to lower the platform 50 and the associated sections of the track 24. The lowering of this portion of the track 24 will lower the slab carts 20 positioned thereon in the slab discharge position to deposit the slab 14 onto the rolls of the roller table 16. The roller table 16 will then convey the slab 14 downstream for subsequent processing. The cylinders 52 can be extended to return the platform 50, track 24 and slab carts 20 to the position illustrated in FIG. 5. Drive motor 44 can then be actuated to move the drive chain 40 and slab carts 20 to the slab loading position illustrated in FIGS. 1 and 2 so that the process can be repeated for subsequent slabs.

The drop-out conveyor 10 of the present invention offers many advantages over the prior art of record. The drop-out conveyor 10 eliminates damage to the equipment or slabs from sliding out of the sloped dropout of the furnace 12. Additionally, the drop-out conveyor 10 of the present design can be easily retrofitted into existing pusher-type slab reheat furnaces 12 having a sloped dropout. Furthermore, the simple, straightforward design of the drop-out conveyor 10 of the present invention represents an economical solution which is easily manufactured, installed and maintained.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A drop-out conveyor for a pusher-type furnace, said conveyor comprising:

at least one reciprocating slab cart movable between a first loading position within the furnace for receiving a slab thereon, and a second discharge position outside of the furnace for discharging the slab;

a reciprocating slab table positioned on each said slab cart, said slab table horizontally movable relative to a horizontal position of said slab cart between an extended slab receiving position and a retracted slab transporting position;

a track supporting each said cart, said track extending at least between said first loading position and said second discharge position; and a means for reciprocating each said cart between said first position and said second position.

2. The drop-out conveyor of claim 1 wherein each said slab table includes a substantially planar base and a slab stop extending up from said base substantially perpendicular thereto at a rearward portion thereof.

3. The drop-out conveyor of claim 1 further including a piston on each said slab cart which is coupled to said slab table for reciprocating said slab table relative to said slab cart.

4. A drop-out conveyor for a pusher-type furnace, said conveyor comprising:

at least one reciprocating slab cart movable between a first loading position within the furnace for receiving a slab thereon, and a second discharge position outside of the furnace for discharging the slab;

a track supporting each said cart, said track extending at least between said first loading position and said second discharge position;

at least one drive chain and a linkage coupling each said slab cart to one said drive chain; and a means for reciprocating each said cart between said first position and said second position.

5. The drop-out conveyor of claim 4 wherein said means for reciprocating each said cart includes at least one reciprocating motor reversibly driving said at least one drive chain.

6. A drop-out conveyor for a pusher-type furnace, said conveyor comprising:

at least one reciprocating slab cart movable between a first loading position within the furnace for receiving a slab thereon, and a second discharge position outside of the furnace for discharging the slab;

a track supporting each said cart, said track extending at least between said first loading position and said second discharge position, wherein at least a portion of said track is movable; and a means for reciprocating each said cart between said first position and said second position.

7. The drop-out conveyor of claim 6 further including a piston coupled to said track for raising and lowering at least a portion of said track.

8. A drop-out conveyor for a pusher-type furnace, said conveyor comprising:

at least one reciprocating slab cart movable between a first loading position within the furnace for receiving a slab thereon, and a second discharge position outside of the furnace for discharging the slab;

a track supporting each said cart, said track extending at least between said first loading position and said second discharge position; and a means for reciprocating each said cart between said first position and said second position, wherein said discharge position is aligned with a roller table and wherein each said slab cart and said track supporting said cart is positioned between adjacent rollers of the roller table.

9. The drop-out conveyor of claim 8 wherein a plurality of said slab carts is provided, each said slab cart supported on one said track.

10. The drop-out conveyor for a pusher-type furnace having a sloped drop-out conveyor comprising:

a reciprocating drive chain;

a reciprocating slab receiving means coupled to said drive chain adapted to be driven up the sloped dropout of the furnace by said drive chain to a slab receiving position to receive at least one slab thereon, and adapted to be driven from said slab receiving position to a slab discharge position outside of the furnace by said drive chain; and a means for reciprocally moving said drive chain.

11. The drop-out conveyor of claim 10 further including a track supporting said slab receiving means.

12. The drop-out conveyor of claim 11 wherein said reciprocating slab receiving means includes a slab cart.

13. The drop-out conveyor of claim 12 wherein said reciprocating slab receiving means further includes a reciprocating slab table positioned on each said slab cart, said slab table movable between an extended slab receiving position and a retracted slab transporting position.

14. The drop-out conveyor of claim 13 wherein each said slab table includes a substantially planar base and the top of the slab extending up from said base substantially perpendicular thereto at a rearward portion thereof.

15. The drop-out conveyor of claim 11 further including means for raising and lowering at least a portion of each said track.

16. A discharge conveyor for transporting workpieces from a furnace to a roller table, said conveyor comprising:

a plurality of tracks, each said track positioned between a pair of rollers of the roller table and extending into a discharge end of the furnace; and a reciprocating workpiece cart on each said track, each said workpiece cart movable between a workpiece loading position within the furnace for receiving a workpiece thereon, and a workpiece discharge position aligned with the roller table for discharging a workpiece thereto.

17. The discharge conveyor of claim 16 further including means for raising and lowering at least a portion of each said track.

18. The discharge conveyor of claim 16 further including means for reciprocating each said workpiece cart.

19. A method of discharging slabs from a pusher-type slab reheat furnace having a sloped dropout, said slab discharge method comprising the steps of:

a) moving a slab cart to a slab receiving position at an upper-end of said sloped dropout;

b) pushing a slab onto said slab cart;

c) moving said slab cart and said slab along said sloped dropout to a discharge position outside of said furnace; and d) moving said slab from said slab cart to a subsequent processing line.

* * * * *